US012799850B2

(12) United States Patent
Shearer et al.

(10) Patent No.: US 12,799,850 B2
(45) Date of Patent: Nov. 17, 2026

(54) ADDRESSABLE SWITCH AND ORIENTING DEVICE ADAPTOR FOR A PERFORATING GUN

(71) Applicant: Greenwell Engineering, Inc., Weatherford, TX (US)

(72) Inventors: Gary Shearer, Flint, TX (US); Michael Wroblicky, Granbury, TX (US); Chris Reed, Weatherford, TX (US)

(73) Assignee: Greenwell Engineering, Inc., Weatherford, TX (US)

( * ) Notice: Subject to any disclaimer, the term of this patent is extended or adjusted under 35 U.S.C. 154(b) by 0 days.

(21) Appl. No.: 19/181,419

(22) Filed: Apr. 17, 2025

(65) Prior Publication Data

US 2025/0327385 A1 Oct. 23, 2025

Related U.S. Application Data

(60) Provisional application No. 63/636,164, filed on Apr. 19, 2024.

(51) Int. Cl.
*E21B 43/117* (2006.01)
*E21B 43/119* (2006.01)

(52) U.S. Cl.
CPC ..... *E21B 43/117* (2013.01); *E21B 43/119* (2013.01)

(58) Field of Classification Search
CPC ..... E21B 43/117; E21B 43/119; E21B 47/01
See application file for complete search history.

(56) References Cited

U.S. PATENT DOCUMENTS 4,523,650 A * 6/1985 Sehnert ..... F42D 1/04 175/4.56
4,655,138 A * 4/1987 Regalbuto ..... F42B 3/08 102/307
4,739,707 A * 4/1988 Regalbuto ..... E21B 43/117 102/307
4,800,815 A * 1/1989 Appledorn ..... E21B 43/117 102/331
5,952,603 A * 9/1999 Parrott ..... E21B 43/117 102/312
6,487,973 B1 * 12/2002 Gilbert, Jr. ..... E21B 43/117 102/312
11,066,925 B2 * 7/2021 Ligneul ..... G01P 5/10
12,140,022 B1 * 11/2024 Jackson ..... E21B 47/12
12,270,284 B1 * 4/2025 Nemez ..... E21B 43/1185
2002/0088620 A1 * 7/2002 Lerche ..... F42D 1/05 166/250.01
2003/0121442 A1 * 7/2003 Gilbert, Jr. ..... E21B 43/117 102/312
2004/0104029 A1 * 6/2004 Martin ..... E21B 43/11857 166/298

(Continued)

FOREIGN PATENT DOCUMENTS

BR 102014011707 A2 * 1/2019 ..... G01N 27/18
NO 314204 B1 * 2/2003 ..... E21B 43/117

(Continued)

*Primary Examiner* — Jennifer H Gay

(57) ABSTRACT

A perforating gun system for downhole operations within a wellbore is provided. The perforating gun system includes an adaptor for holding an electrical component such as a switch and/or an orienting sensor or other device where the adaptor is configured to be installed within a cutout of a perforating gun load tube.

7 Claims, 10 Drawing Sheets

(56) References Cited

U.S. PATENT DOCUMENTS

| | | | | |
|---|---|---|---|---|
| 2005/0173118 | A1* | 8/2005 | Li | E21B 43/117<br>175/4.6 |
| 2013/0329522 | A1* | 12/2013 | Skinner | E21B 47/024<br>367/25 |
| 2014/0338439 | A1* | 11/2014 | Ligneul | G01P 5/10<br>73/152.33 |
| 2017/0032653 | A1* | 2/2017 | Crawford | E21B 47/16 |
| 2018/0216445 | A1* | 8/2018 | Collins | E21B 43/116 |
| 2022/0333906 | A1* | 10/2022 | Lowe | E21B 43/119 |
| 2023/0008361 | A1* | 1/2023 | Lowe | E21B 43/117 |
| 2023/0304384 | A1* | 9/2023 | Rajaram | E21B 43/118 |
| 2024/0076965 | A1* | 3/2024 | Loehken | E21B 43/119 |
| 2024/0287877 | A1* | 8/2024 | Bradley | E21B 43/116 |
| 2025/0327385 | A1* | 10/2025 | Shearer | E21B 43/117 |

FOREIGN PATENT DOCUMENTS

| | | | | |
|---|---|---|---|---|
| WO | WO-2022184731 | A1 * | 9/2022 | E21B 43/117 |
| WO | WO-2023227775 | A1 * | 11/2023 | E21B 29/02 |

* cited by examiner

ADDRESSABLE SWITCH AND ORIENTING DEVICE ADAPTOR FOR A PERFORATING GUN

CROSS REFERENCE TO RELATED APPLICATIONS

This application claims priority and benefit from U.S. Provisional Patent Application No. 63/636,164 filed on Apr. 19, 2024, entitled "Methods and Systems Associated with a Shaped Charge Cutout Adaptor for Holding an Orienting Device," the content of which is incorporated in its entirety herein by reference.

BACKGROUND OF THE INVENTION

Technical Field

Embodiments of the subject matter disclosed herein generally relate to downhole tools for perforating a wellbore and more particularly, to an adaptor for holding an electrical component such as a switch and/or an orienting sensor or other device where the adaptor is configured to be installed within a cutout of a perforating gun load tube.

Discussion of the Background

Once a wellbore is drilled and the wellbore casing installed and cemented, it is necessary to provide communication between the oil and gas containing formation and the casing. Downhole tools such as perforating guns, plugs and setting tools are assembled into a tool string and lowered into the wellbore to isolate prescribed zones or stages and perforation of the casing is carried out in a series of "plug and perf" operations.

Briefly, those operational steps may include lowering the tool string downhole via a wireline or other conveyance, setting a plug (a "frac plug") with a setting tool above a stage to be stimulated via perforation, perforating a first stage with a first perforating gun or cluster of guns, moving the tool string uphole via the wireline, setting a new plug above the just perforated stage and repeating the process in the uphole direction. A controller at the surface controls the speed of the wireline and also sends various commands along the wireline to actuate one or more guns of the gun cluster and the setting tools.

A typical perforating gun 100 as shown in FIG. 1 may be part of a cluster of perforating guns connected to each other by subs 110. A perforating gun 100 is typically comprised of a main carrier tube 102 which houses the components of the perforating gun including one or more explosive shaped charges 150 connected to one another by detonating cord ("det cord") 140. The number and arrangement of shaped charges 150 is predetermined to provide a designed perforating pattern and density. Their arrangement is thus fixed by installing the shaped charges 150 into a load tube 104 (also referred to as a charge tube) located inside the main carrier tube 102 which includes corresponding cutouts 106 configured to receive and hold each shaped charge 150 in the desired position and orientation.

The carrier tubes 102 of adjacent perforating guns 100 are connected together via tandem or other types of subs 110 which may house various components including detonators, switches, through wires and electronics to provide connectivity between guns or other tools of the tool string and the wireline (not shown). In other gun systems, certain or all of these components may be located directly inside the carrier tube 102.

A switch 120 which may be an addressable switch programmed with an address unique to a specific gun within the gun cluster is accessible to a controller at the surface and actuated by a wireline command (or in some instances by detonation of a downstream gun). When a command from the surface actuates the detonator 130, the detonator detonates the shaped charges 150 of gun 100 by initiating the detonating cord 140. As mentioned, in most modern perforating system, addressable switches are utilized which include a programmable processor to provide increased safety, selective firing control and customization. Other electronics may be integrated into the switch which may include the ability to sense and convey additional information to the surface, such as orientation of the gun within the wellbore.

Shaped charges 150 may be arranged to shoot omnidirectionally whereby the charges are pointing in all angular directions, often in a spiral formation as shown in FIG. 1. However, a perforating plan may include the goal to perforate a well in a particular direction or within a limited range of directions. In the horizontal portion of a wellbore the objective may be to shoot some or all shaped charges in a downward or upward direction or other range in order to better target a particular formation. In certain oriented gun systems, the shaped charges 150 may be rigidly mounted within the carrier tube 102 and the gun is conveyed into the wellbore with a physical bias so that the gun is oriented in the desired direction.

In other approaches; the charges 150 are rotatably mounted in a load tube 104 with cutouts 106 in a single line. The load tube is weighted by a swivel apparatus such that gravity self-orients the charges in the desired direction when conveyed into the horizontal portion of the wellbore. Regardless of the method of orienting the shaped charges, an orienting sensor which may be separate or integrated with the addressable switch may be utilized to monitor and report the load tube's rotational position and inclination.

A drawback to current sub or carrier tube installed addressable switches with orienting sensors is an inability to provide a simple method and form factor to position the switch and orienting sensor in correspondence with the angle of the shaped charges. Hence, there is a need for a simplified approach to mount the switch and/or orienting sensor within the gun apparatus to affix and maintain it in a constant position relative to the shaped charges.

SUMMARY OF EXAMPLE EMBODIMENTS

According to an embodiment, there is a downhole perforating gun system which includes an outer carrier tube, a shaped charge load tube within the outer carrier tube with more than one cutout, at least one shaped charge mounted within one cutout of the load tube, and an adaptor mounted within another cutout. The adaptor includes an adaptor body with an upper first end and a lower second end, a receptacle with a first and a second opening, wherein the first opening receives a perforating gun electrical component, and the second opening provides connectivity to the electrical component.

According to another embodiment, there is an adaptor for a shaped charge load tube of a perforating gun system which includes an adaptor body with an upper first end and a lower second end; a receptacle with a first and a second opening, wherein the first opening receives a perforating gun electrical component, and the second opening provides connectivity to the electrical component. The adaptor body is mounted within a cutout of a shaped charge load tube of a perforating gun.

According to yet another embodiments, there is an adaptor for a shaped charge load tube of a perforating gun system which includes an adaptor body having a first end and a second end, a receptacle that receives a perforating gun electrical component, wherein the adaptor body is mounted within a cutout of a shaped charge load tube of a perforating gun.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF EXAMPLES OF THE INVENTION

The following description of the embodiments refers to the accompanying drawings. The same reference numbers in different drawings identify the same or similar elements. The following detailed description is intended to provide enabling examples of the invention and its use and does not limit the invention. Instead, the scope of the invention is defined by the appended claims. The following embodiments are discussed, for simplicity, with regards to an adaptor for use in a downhole perforating gun and more particularly, an adaptor for mounting switches and orienting sensors within a cutout of a shaped charge load tube of a perforating gun. However, the embodiments discussed herein are not limited to such elements as the invention may also enable other devices and components, such as detonators and ignitors, to be mounted in an adaptor into a cutout of a load (or charge) tube.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. The drawings are intended to be illustrative of the claimed features and unless stated otherwise are not to scale. Where a dimension of a given feature may be pertinent, the detailed description will indicate one or more examples of the range and units of said dimension where needed to enable the subject matter. Further, the described features, structures or characteristics may be combined in any suitable manner in one or more embodiments.

The present invention provides a simplified approach to mounting electrical components, such as switches and sensors, including addressable switches integrated with an orienting sensor, into a downhole perforating gun. An adaptor configured to hold a switch and/or sensor for ready mounting into a load tube cutout is disclosed that maintains an orientation of the sensor that is fixed with respect to the orientation of a shaped charge located in another cutout of the same load tube. Such arrangement thus provides that the sensed orientation of the shaped charges is known throughout the conveyance of the perforating gun into the wellbore without additional dedicated mounting hardware or orientation calculation. It is a further aspect of the present invention that the adaptor may be installed in a standard or dedicated load tube cutout in place of a single shaped charge. This potentially minimizes the need for added length to the perforating gun or gun cluster as compared to conventional systems that install such components typically horizontally into a sub located between guns or into an end of a gun carrier.

Figure 1:
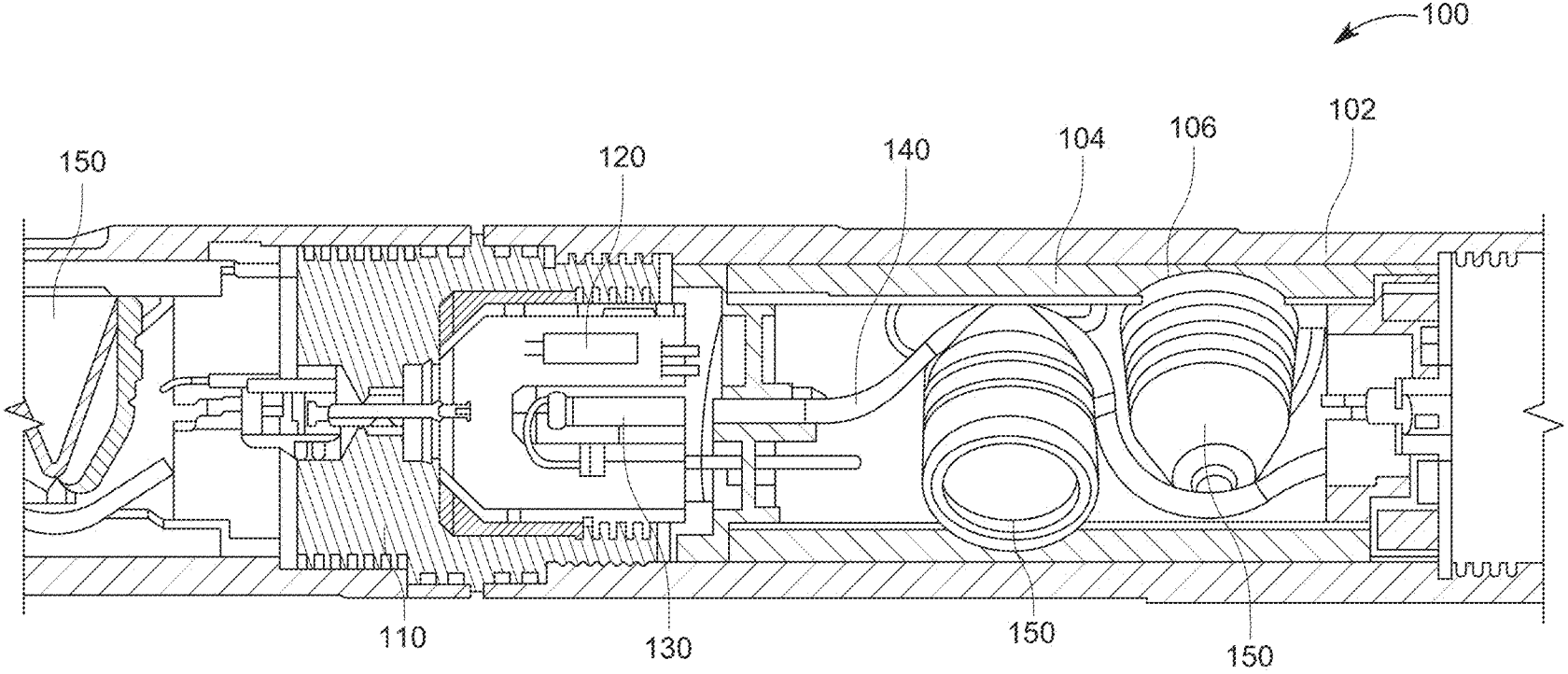
FIG. 1 (BACKGROUND ART)
FIG. 1 shows a prior art perforating gun with an addressable switch located within a tandem sub.
Figure 2A:
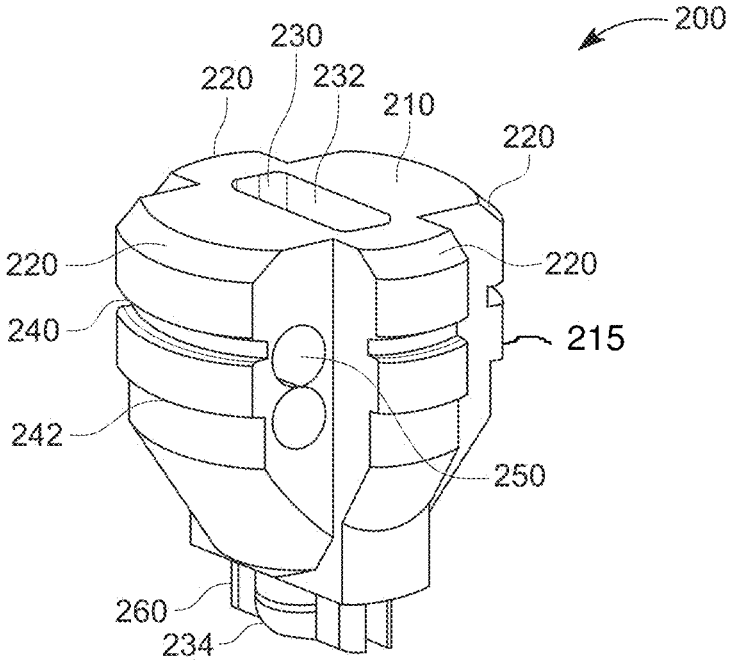
FIGS. 2A and 2B show an embodiment of an adaptor for housing an electrical component in a cutout of a load tube.
Figure 2B:
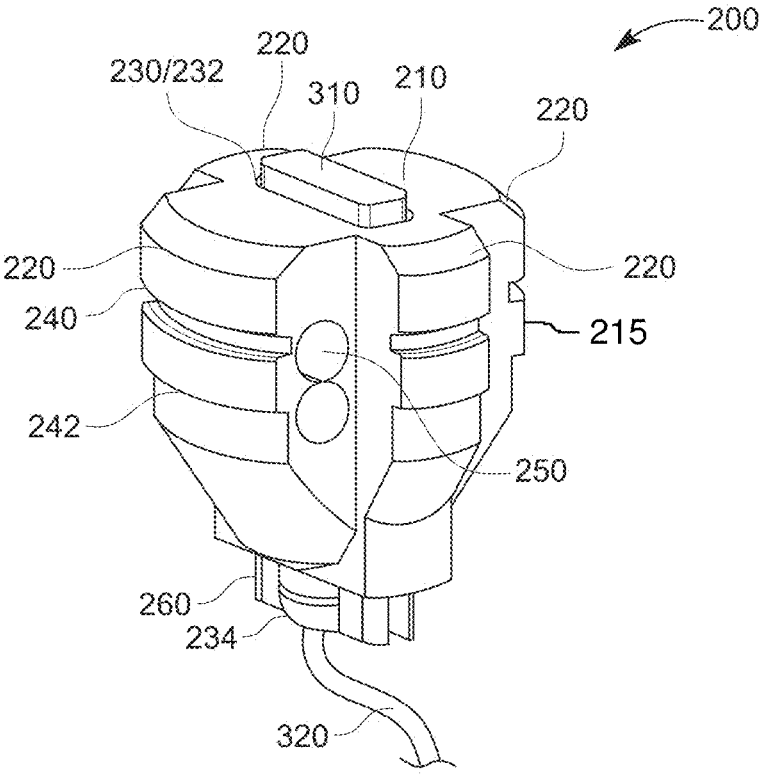

An exemplary embodiment of an adaptor for housing an electrical component and configured to be mounted into a cutout of a shaped charge load tube of a perforating gun system is shown in FIGS. 2A and 2B. In this example, adaptor 200 includes an adaptor body 210 which may be generally cylindrical in shape, or in a preferred embodiment as shown, with side walls 215 tapered conically such that the shape of body 210 approximates the shape and dimensions of a shaped charge. Adaptor 200 may be composed of metal, metal alloy, plastic or a composite material machined, formed or 3D printed as a single piece or be comprised of a combination of parts each of the same or different materials coupled together to form a unit. Body 210, in this example, includes side protrusions 220 (four are shown) which maintain the general conical shape while providing flat surfaces upon which one or more through holes 250 (or other features) may be provided that allow for the running of det cord and/or electrical connections through body 210.

A receptacle 230 comprised of a cavity with a first opening 232 on body 210 (such as the upper end as shown) with the receptacle cavity having a shape and volume suitable to receive an electrical component. A second receptacle opening 234 may be located on the lower end of body 210 to provide connectivity to the electrical component installed in receptacle 230. Also, a tab 260 at the bottom of body 210 may optionally be included to hold det cord or other wire(s) that transverse the interior of perforating gun load tube 104.

Adaptor body 210 may also include various structural elements to fixedly engage adaptor 200 within a cutout 106 of a load tube 104. In the example shown in FIG. 2A, a groove 240 and a ledge 242 are formed on the circumference of body 210. To be discussed in greater detail below, ledge 242 provides an insertion depth stop to stabilize the position of adaptor 200 within cutout 106. Alternatively, groove 240 which may be machined or formed into body 210 above or below or without ledge 242 may engage the wall of cutout 106. Other embodiments to fix adaptor 200 within cutout 106 may include snap fits, threaded connections, set screws, snap rings, twist and lock, clips or other mechanical coupling methods that are readily contemplated by those skilled in the mechanical arts having the benefit of the present disclosure. For example, adaptor 200 may be fixed in cutout 106 using standard charge holder clips that are commonly used to fix shaped charges 150 into the load tube 104. FIG. 2B illustrates adaptor 200 with an electrical component or components 310 (e.g., an addressable switch with an orienting sensor) installed into receptacle 230 with electrical leads 320 extending from receptacle second opening 234 at the bottom of adaptor body 210.

Figure 3A:
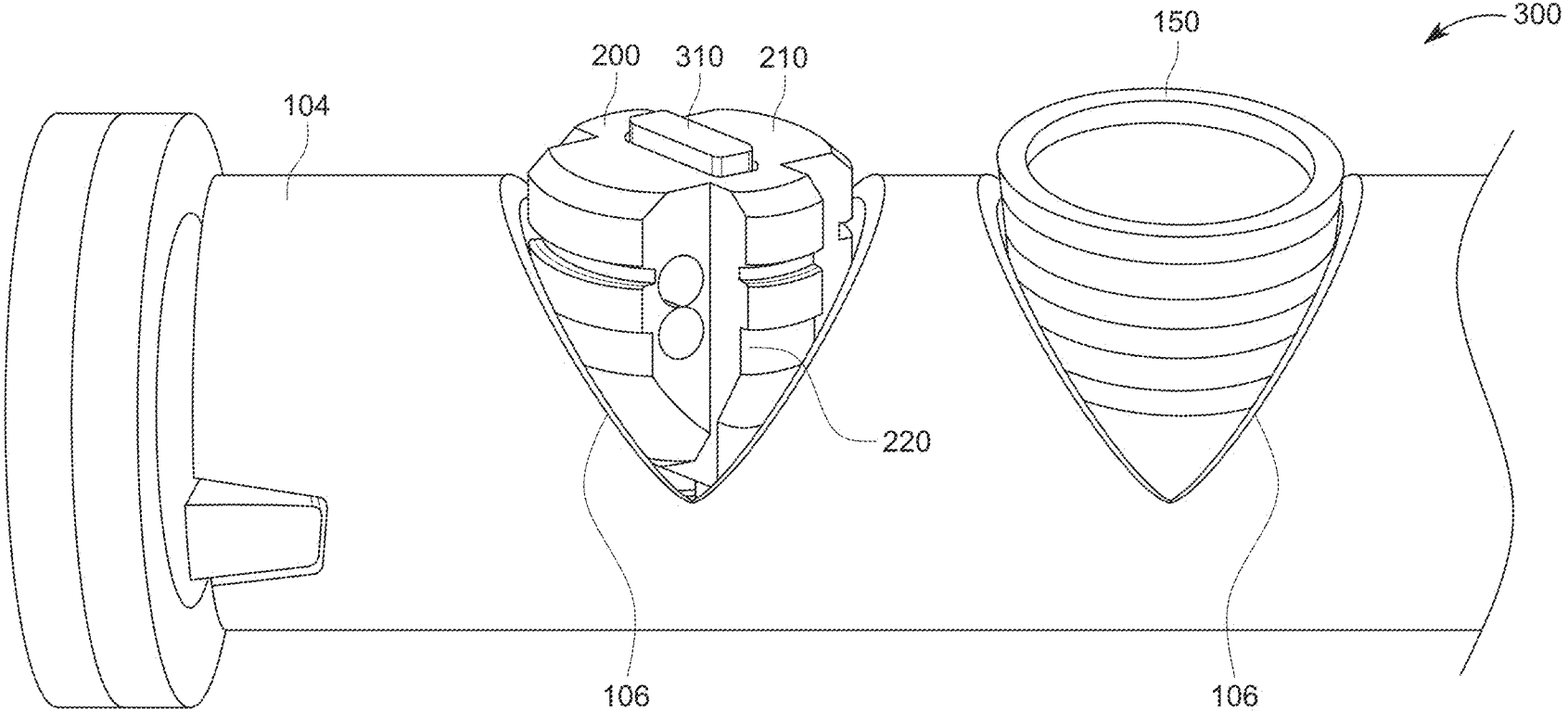
FIGS. 3A and 3B shows an embodiment of a perforating gun system with the adaptor and electrical component installed.
Figure 3B:
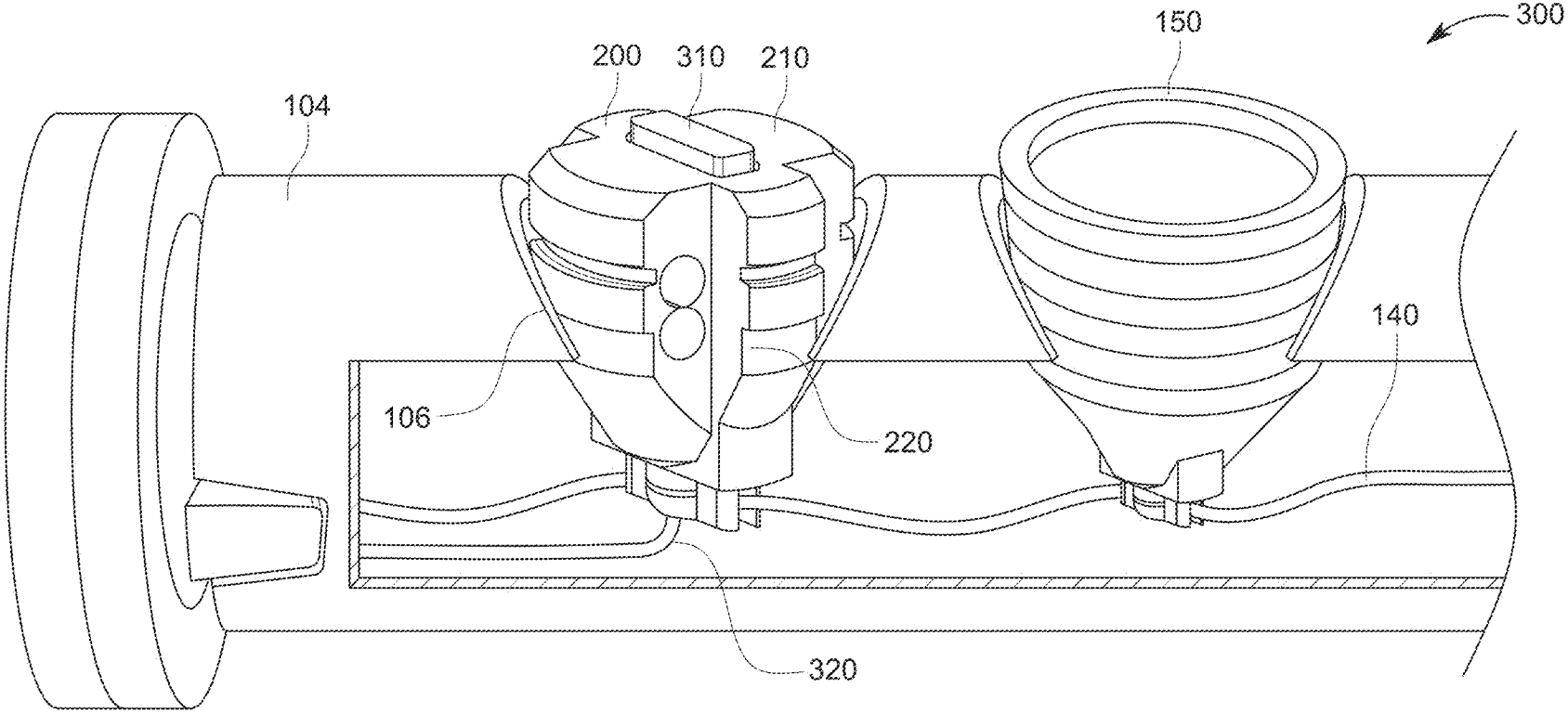

FIGS. 3A and 3B depict an exemplary perforating gun system 300 with adaptor 200 installed into a first cutout 106 of a load tube 104 adjacent a shaped charge 150 installed in a second cutout of the load tube. (In this example, for purposes of clarity, the main outer carrier tube 102 is not shown.) Adaptor 200 has an electrical component 310 installed into receptacle 230. In certain embodiments, electrical component 310 may comprise an addressable switch with an integrated orienting sensor. FIG. 3B gives another view of perforating gun system 300 with the load tube 104 cutaway to show the connectivity of det cord 140 and electrical leads 320 of switch 310.

Figure 4:
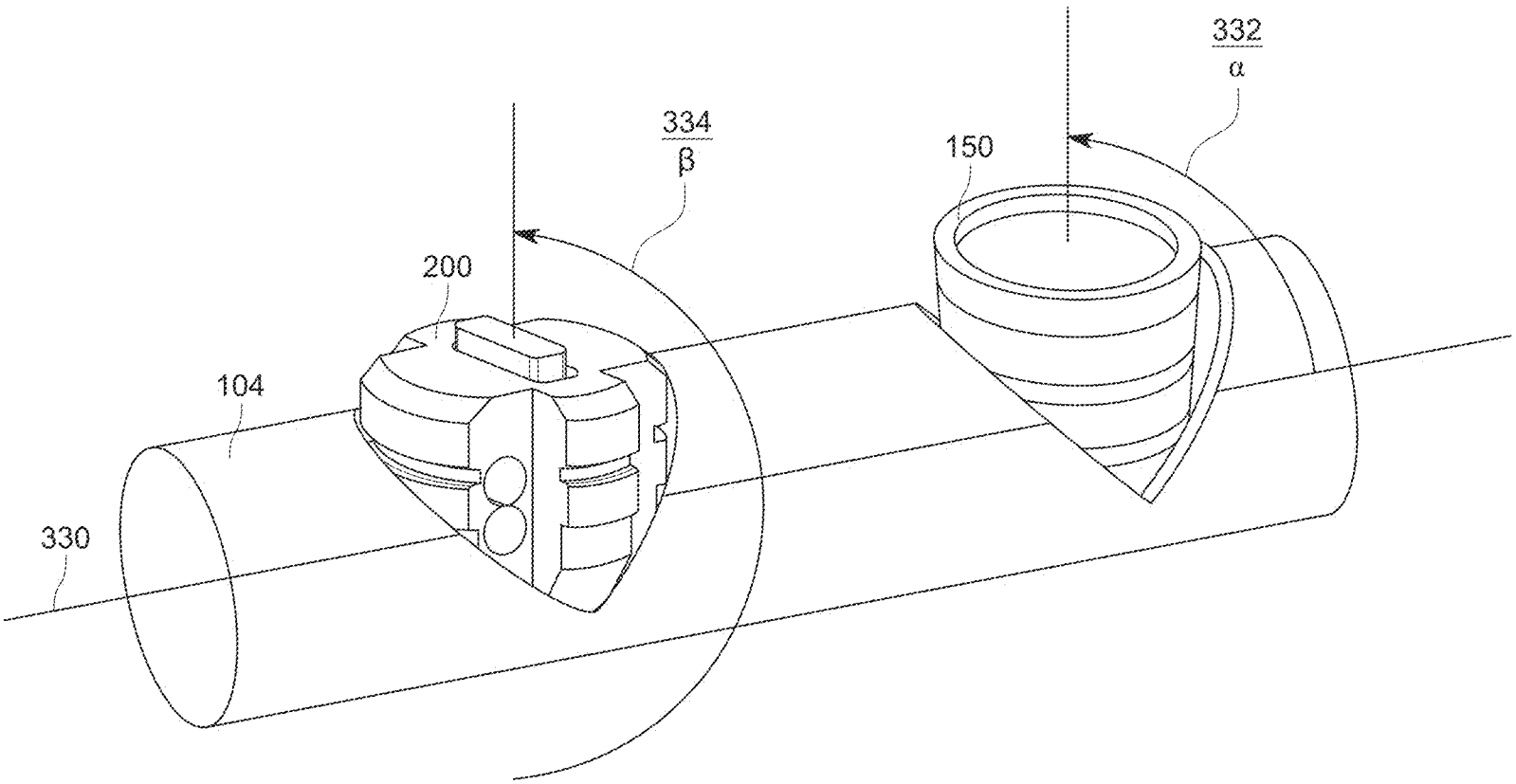
FIG. 4 illustrates the orientation of the adaptor and a shaped charge when installed in a perforating gun.

Thus, when installed as shown, adaptor 200 maintains switch and sensor 310 in an orientation that is the same or substantially the same (i.e., within a few to several degrees) as the orientation of shaped charge 150 relative to the horizontal axis 330 of the load tube 104. Here, the term orientation may refer to one or more angles depending upon the capabilities of the sensor type to be discussed in greater detail below. For example, as given in FIG. 4, a first angle 332 ("$\alpha$") is an angular orientation or tilt left or right with the page, and a second angle 334 ("$\beta$") is an angular orientation or tilt into or out of the page of the shaped charge 150 and adaptor 200. An orienting sensor may comprise any of several types including but not limited to a single or multi-axis accelerometer, a multi-axis magnetometer (e.g., single axis, 3-axis or 6 axis etc.), or a magnetometer with an accelerometer, or a magnetometer with an accelerometer and a gyroscope, gyroscope, and/or other degree of freedom ("DOF") device which is capable of sensing the rotational position of the perforating gun, or more specifically, the orientation of one or more shaped charges of the perforating gun in a wellbore.

In certain embodiments, electrical component 310 mounted within adaptor 200 may comprise an addressable switch integrated with an orienting sensor. An addressable switch with orienting sensor is capable of selectively firing individual perforating guns within a cluster of guns after sensing one or more orientation angles of the adaptor 200, which if mounted in a cutout 106 in line with a similar cutout including a shaped charge 150 will be fixed at equivalent angular orientation. Most 3-axis accelerometers determine the accelerometer pitch and roll orientation angles from sensing a gravitational field vector relative to a zero-degree axis reference. This information is then relayed via the wireline to a surface controller and informs an operator whether the desired perforating direction is achieved. In typical perforating gun systems, the switch and orienting sensor are mounted either within a sub 110 at some known or variable angle or generally horizontally within the carrier 102 or load tube 104 and rely on axis 330 as a zero-axis reference. However, the angle of switch 310 relative to this axis may be inexact due to variabilities in gun assembly, and in any event, the switch orientation is different from the axis 332/334 of a shaped a charge 150.

Figure 5:
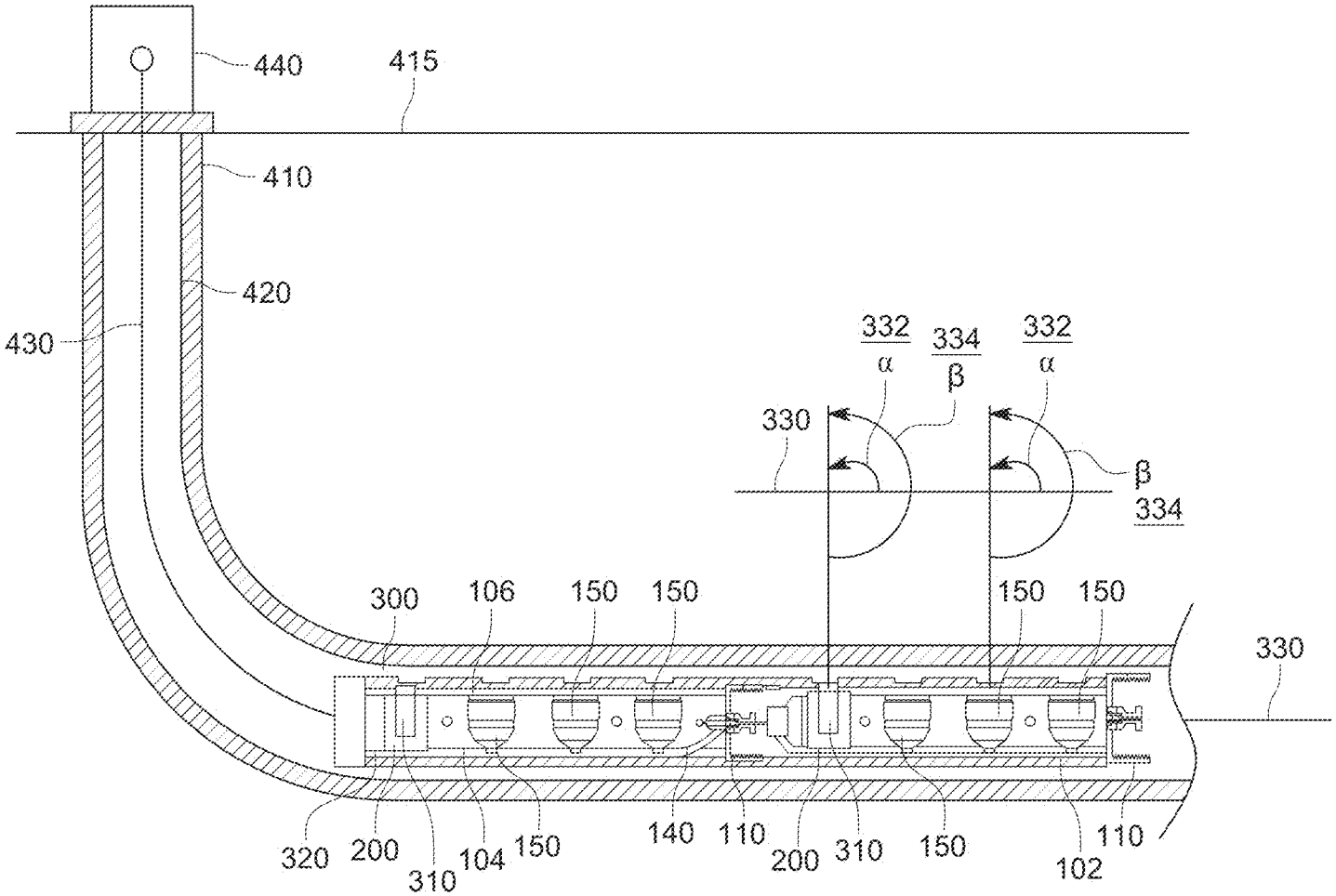
FIG. 5 shows an exemplary perforating gun system located downhole in a wellbore

The present system 300 thus simplifies the fixing of the relative angle between an orienting sensor 310 and shaped charge(s) 150 while minimizing tool string length in order to accommodate these components. FIG. 5 illustrates a perforating gun system 300 deployed via wireline 430 into the horizontal portion of a wellbore 410 below the surface 415. Note that for purposes of clarity of presentation, a simplified representation of a cluster of two perforating guns connected by sub 110 where each gun includes three shots (shaped charges 150) each is illustrated. However, numerous other configurations are possible, and not all components of a typical perforating tool string are shown. In this example, perforating gun system 300 is configured to shoot upwards into the formation and thus shaped charges 150 and adaptor 200 are installed into linearly aligned cutouts 106 of load tubes 104 located within a main carrier tube 102. Thus, once mounted, electrical components 310 comprising in this example, addressable switches with integrated orienting sensors are oriented the same as the shaped charges 150 in terms of angles 332 and/or 334 relative to load tube 104 axis 330.

Figure 6A:
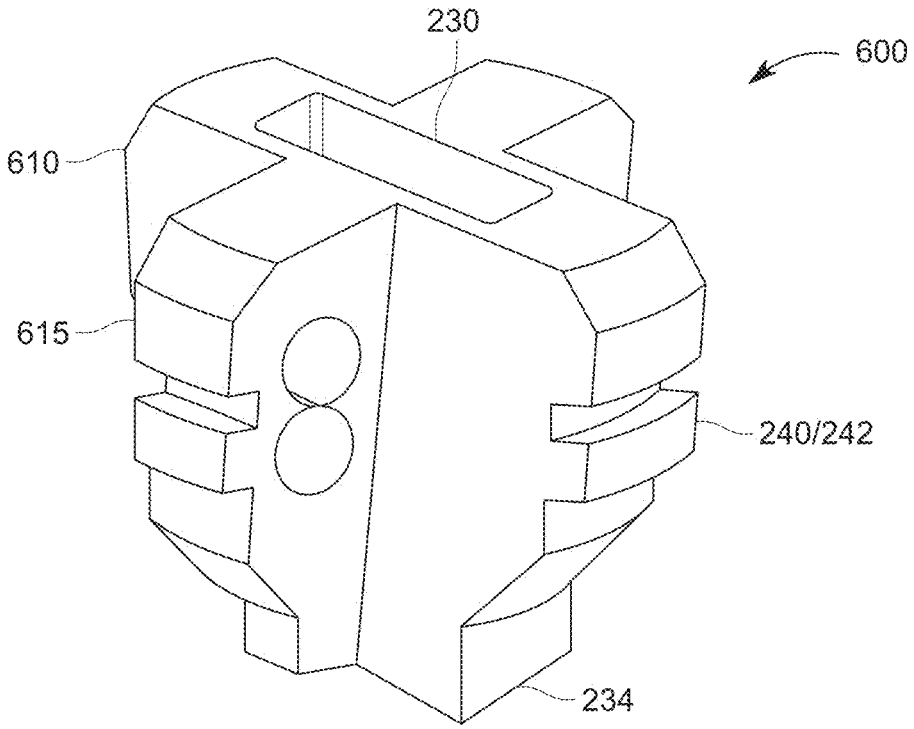
FIGS. 6A and 6B show another embodiment of an adaptor for housing an electrical component in a shaped charge cutout of a load tube with a simplified adaptor body.
Figure 6B:
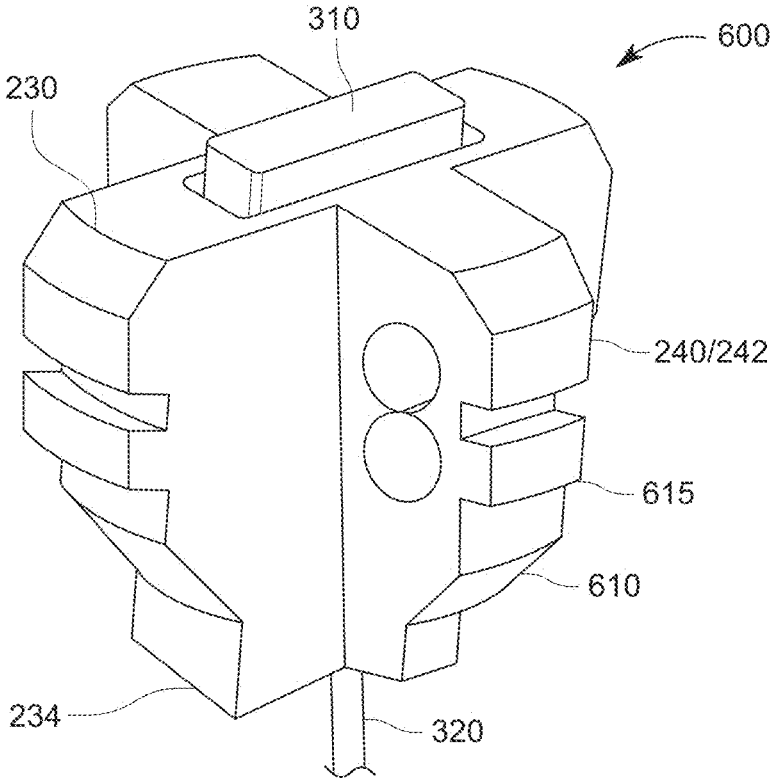

Other embodiments of the adaptor are given in FIGS. 6A-6B and FIGS. 7A-7B. FIG. 6A shows an adaptor 600 with body 610 comprised of two intersecting wedge shaped cross sections rather than the largely cylindrical shaped body 210 as described above in relation to adaptor 200. The outermost sidewalls 615 of body 610 in this example are however in certain embodiments also tapered conically such that the overall shape of body 610 approximates the shape and dimensions of a shaped charge 150 as described earlier. Outermost sidewalls 615 may include similar structural elements (e.g., groove 240 and/or ledge 242 as shown) as described prior to engage and affix adaptor 600 to a cutout 106 of load tube 104 (see FIGS. 2A-3B). Also similar to adaptor 200, adaptor 600 has a receptacle 230 for inserting an electrical component 310, which may be an addressable switch with an integrated orienting sensor. Electrical leads 320 may also similarly emerge from a second lower opening 234 to provide connection to component 310 as shown in FIG. 6B.

Figure 7A:
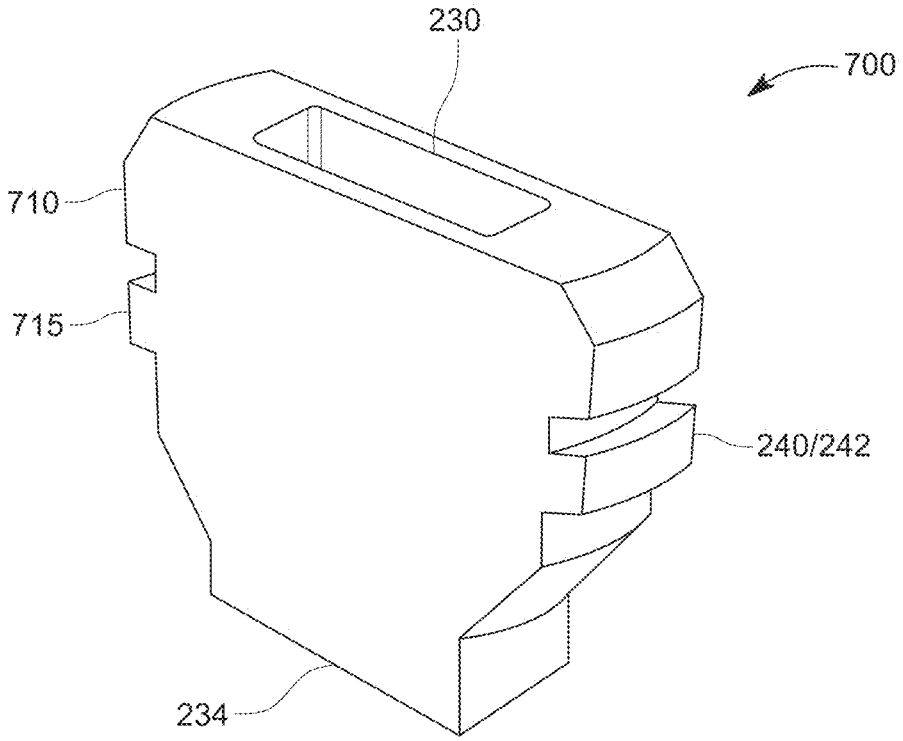
FIGS. 7A and 7B show another embodiment of an adaptor for housing an electrical component in a shaped charge cutout of a load tube with a further simplified adaptor body.
Figure 7B:
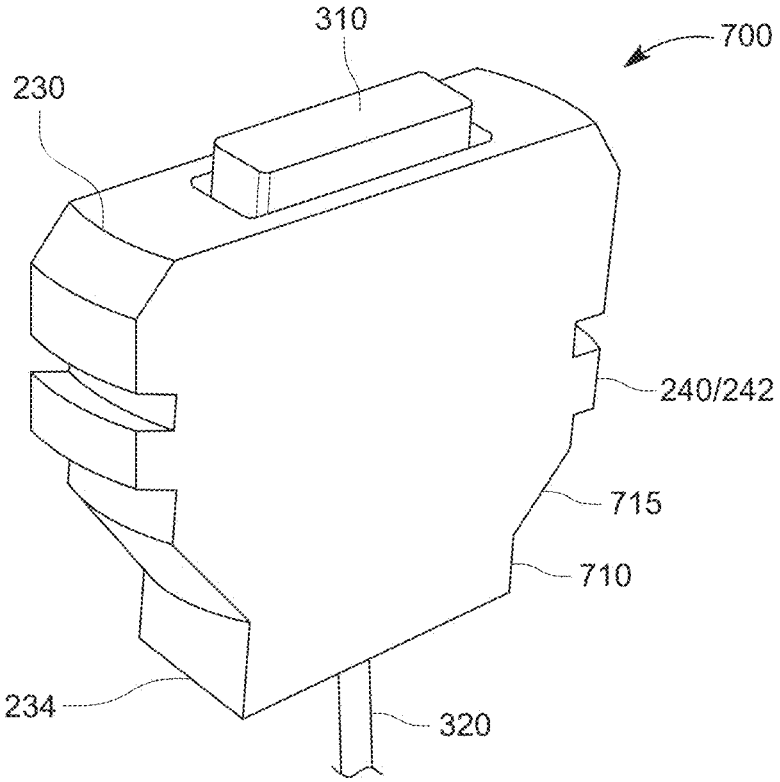

FIGS. 7A and 7B show another embodiment of a further simplified adaptor 700. In this example, adaptor body 710 is reduced to a single wedge shape rather than the two intersecting cross-sectional wedges of adaptor 600. Body 710 include tapered sidewalls 715 with a tapered shape to similarly approximate the shape of a shaped charge 150. (Here, the tapered sidewalls refers to the two narrow most sides of body 710.) Other features, described above in relation to adaptor 600, including through holes 250, etc. of adaptor 200 may be included with adaptor 700 and other embodiments as well.

Figure 8A:
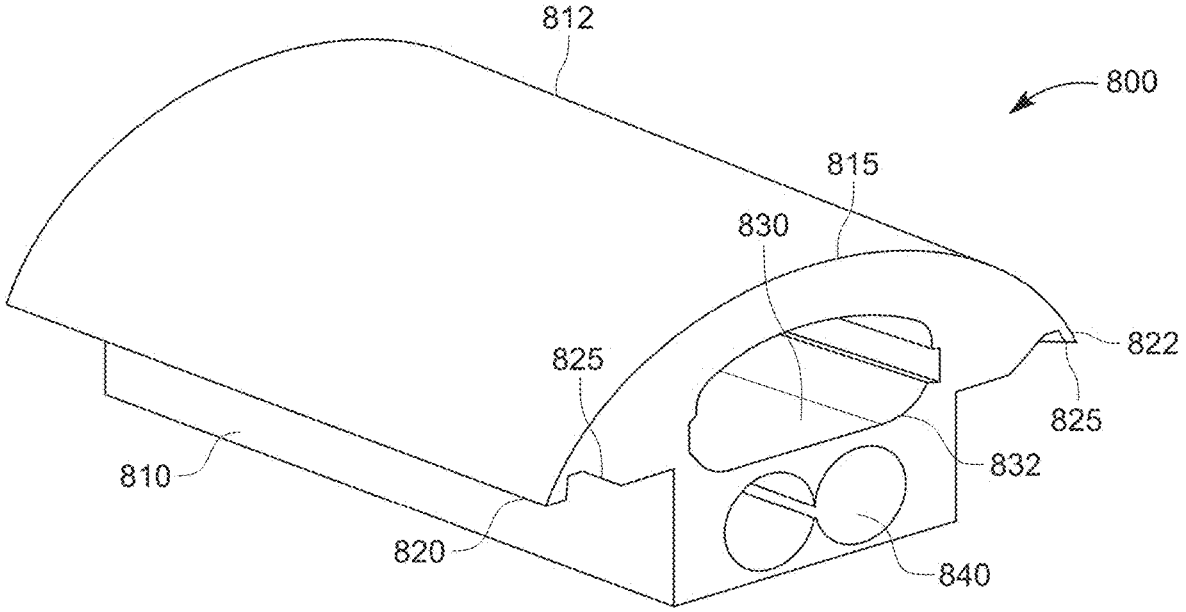
FIGS. 8A and 8B shows another embodiment of an adaptor for housing an electrical component in a separate dedicated cutout of a load tube.
Figure 8B:
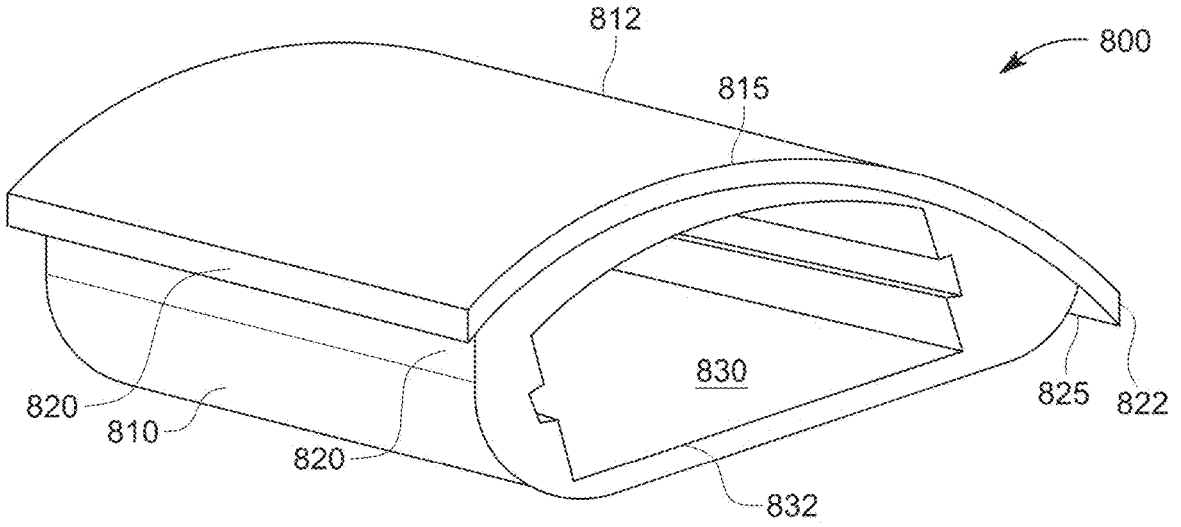

In yet other embodiments there may be a desire to install the adaptor in a manner that orients the electrical component 310 (e.g., a standard switch, or addressable switch with or without an orienting sensor, etc.) in the adaptor horizontally (or parallel) with respect to the load tube 104 axis 330. FIGS. 8A and 8B illustrate an adaptor 800 that is configured to be installed into a non-shaped charge cutout 910 (e.g., a rectilinear or other shaped cutout different from a shaped charge 150 cutout 106) of load tube 104 (see FIG. 9). Adaptor 800 includes main body 810 comprising a semi-circular curved outer surface 812 with a radius of curvature 815 that corresponds to the curvature of load tube 104 (and/or the curvature of the main carrier tube 102). Outer surface 812 may have two overhangs 820/822 on either end perpendicular to the lengthwise axis of the adaptor that provide, in this example, one or more lengthwise indentations 825 capable of snapping into the cutout 910 of load tube 104. Receptacle 830 for installing an electrical component 310 is formed from a cavity in body 810 with a first opening 832 one end and an optional second opening 834 (not shown) on the opposite end of body 810. One or more through holes or pockets 840 may be provided in body 810 for passage of det cord 140 or electrical connections, or to hold a detonator 130, initiator or other component. FIG. 8B shows a different iteration of adaptor 800 whereby overhangs 820/822 are not of equal extension thus making the alignment of the adaptor 800 and electrical component 310 off center or off angle while still parallel with respect to the central axis 330 of the load tube 104. Also, receptacle 830 may comprise a larger cavity for larger electrical component(s) 310 and in this example, no through holes 840 are provided. The advantage of such arrangement is to allow the central axis of load tube 104's interior to accommodate additional interior space for other components by shifting adaptor 800 off center while still maintaining parallelity.

Figure 9:
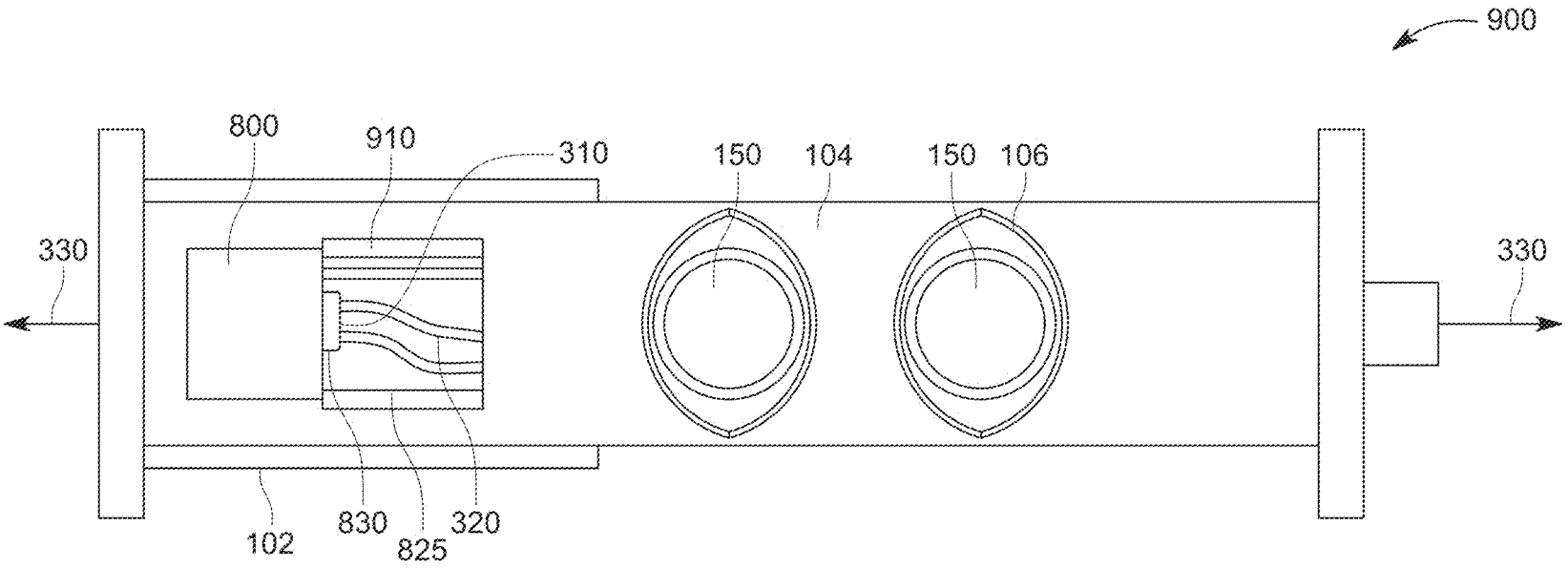
FIG. 9 shows another embodiment of an adaptor that is configured to be installed into a non-shaped charge cutout

FIG. 9 shows an exemplary perforating gun system 900 with adaptor 800 installed in a non-shaped charge cutout 910 of load tube 104 located within main carrier tube 102. (In this depiction, note that carrier tube 102 is shown cutaway for clarity of presentation.) A shaped charge cutout 106 to receive a shaped charge 150 is also shown adjacently (shaped charge is omitted). In this example, overhangs 820/822 with indentations 825 of body 810 engage the cutout 910 and thus affix the longitudinal axis of adaptor 800 and electrical component 310 located with receptacle 830 parallel to the central axis 330 of load tube 104. Adaptor body 810 in this example corresponds to the embodiment of FIG. 8B and thus no through holes 840 are provided and the electrical component leads 320 simply extend from one end of e.g. switch 310. In this configuration, the orientation angle 332 ("$\alpha$") is fixed orthogonally to a vertically oriented shaped charge 150. Thus in this approach any combination of 332/334 angles may be achieved and fixedly set and known relative to the desired orientation of the shaped charges.

What is claimed is:

1. An adaptor for a shaped charge load tube of a perforating gun system, the adaptor comprising:

an adaptor body having a first end and a second end;

a receptacle located within the adaptor body configured to receive an electrical component associated with the operation of the perforating gun;

wherein the adaptor body is configured to be mounted within and fixedly engage a cutout of a shaped charge load tube of a perforating gun and wherein the lengthwise axis of the adaptor and the electrical component is parallel to the longitudinal axis of the load tube.

2. The adaptor of claim 1, wherein the upper body of the adaptor further comprises a semi-circular curved surface with a radius of curvature that corresponds to the curvature of the shaped charge load tube.

3. The adaptor of claim 1, wherein the body of the adaptor further comprises indentations configured to snap fit into the cutout of the shaped charge load tube.

4. The adaptor of claim 1, wherein the electrical component is a switch.

5. The adaptor of claim 4, wherein the switch is an addressable switch.

6. The adaptor of claim 1, wherein the electrical component is an orienting sensor.

7. The adaptor of claim 1, wherein the electrical component is a combination addressable switch and orienting sensor.

* * * * *